US006909243B2

(12) United States Patent
Inukai

(10) Patent No.: US 6,909,243 B2
(45) Date of Patent: Jun. 21, 2005

(54) LIGHT-EMITTING DEVICE AND METHOD OF DRIVING THE SAME

(75) Inventor: Kazutaka Inukai, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 10/438,164

(22) Filed: May 14, 2003

(65) Prior Publication Data

US 2003/0214468 A1 Nov. 20, 2003

(30) Foreign Application Priority Data

May 17, 2002 (JP) ..... 2002-143897

(51) Int. Cl.[7] ..... G09G 3/10; G09G 3/20; G09G 3/32

(52) U.S. Cl. ..... 315/169.3; 315/169.2; 345/76

(58) Field of Search ..... 315/169.3, 169.2, 315/169.4; 313/400, 500, 505; 345/36, 45, 76, 80, 90, 91, 92; G09G 3/10, 3/20, 3/32

(56) References Cited

U.S. PATENT DOCUMENTS 6,376,994 B1 * 4/2002 Ochi et al. ..... 315/169.1
6,650,308 B2 * 11/2003 Kawashima ..... 345/76
2001/0033252 A1 * 10/2001 Yamazaki et al. ..... 345/7
2002/0014851 A1 * 2/2002 Tai et al. ..... 315/169.3

OTHER PUBLICATIONS

Yumoto, A. et al, "Pixel–Driving Methods for Large–Sized Poly–Si AM–OLED Displays," Asia Display/IDW '01, pp. 1395–1398 (2001).

* cited by examiner

*Primary Examiner*—Trinh Vo Dinh
(74) *Attorney, Agent, or Firm*—Cook, Alex, McFarron, Manzo, Cummings & Mehler, Ltd.

(57) ABSTRACT

A novel driving method for conducting gradation display is provided. Also, a signal line driver circuit is provided which includes a current source circuit having a small area. Further, miniaturization and reduction in size of a frame of a light-emitting device can be attained. A gate selection period is divided into plural periods, and a (writing) operation of writing a signal to a pixel having a transistor connected with a scanning line that is selected and a (reading) operation of reading a signal current into a current source circuit connected with a signal line connected with a scanning line that is not selected are performed simultaneously in each of the divided periods in the gate selection period. Therefore, the signal line driver circuit that includes a current source circuit having a small area is provided. Consequently, the miniaturization and reduction in size of the frame of the light-emitting device can be attained.

15 Claims, 11 Drawing Sheets

FIG. 10A
PRIOR ART
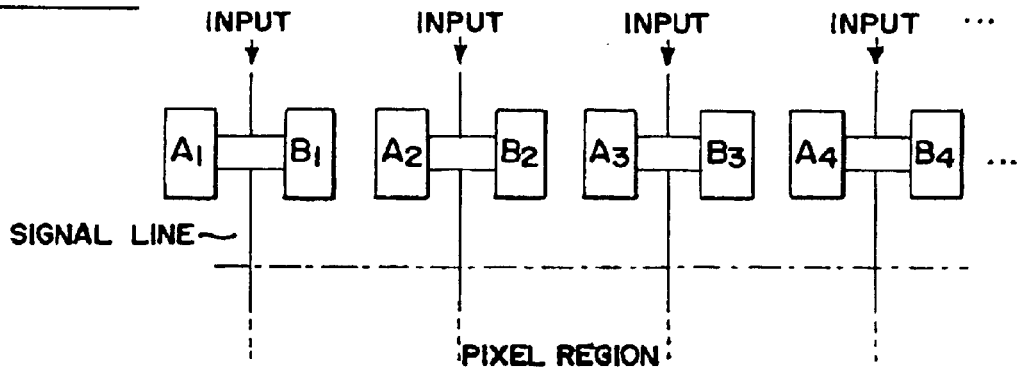
FIG. 10B
PRIOR ART
| | k-th ROW SELECTION | (k+1)-th ROW SELECTION |
|---|---|---|
| A1 | R1 | W1 |
| B1 | W1 | R1 |
| A2 | R2 | W2 |
| B2 | W2 | R2 |
| ⋮ | | |
FIG. 10C
PRIOR ART
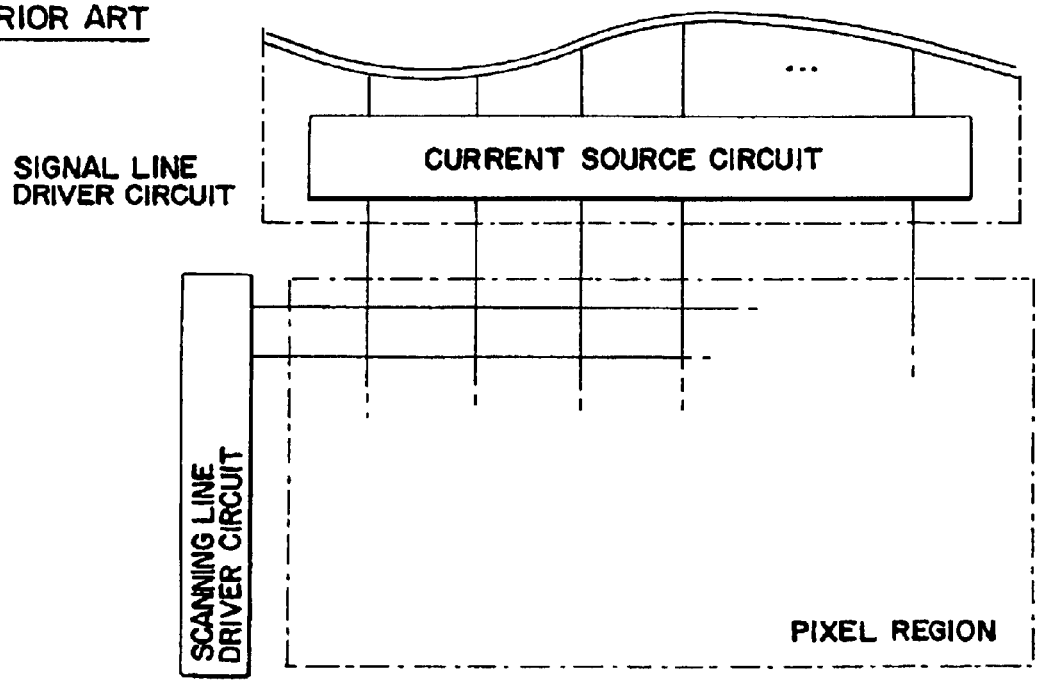

LIGHT-EMITTING DEVICE AND METHOD OF DRIVING THE SAME

BACKGROUND OF THE INVENTION

1. Field of the Invention

The present invention relates to techniques for a semiconductor integrated circuit and its driving method. The invention also relates to a light-emitting device that has a semiconductor integrated circuit of the present invention in its driver circuit portion and a pixel portion. In particular, the present invention relates to an active matrix type light-emitting device in which the semiconductor integrated circuit of the present invention is applied to a signal line driver circuit of the driver circuit portion.

2. Description of the Related Art

In recent years, research and development of light-emitting devices using self-light-emitting elements such as organic light-emitting diodes (OLEDs) have progressed. An OLED has an anode and a cathode, and has a structure in which an organic compound layer is sandwiched between the aforementioned anode and cathode. Light-emitting devices using OLEDs have characteristics in that they have suitably fast response speed for animated displays, low voltage, low power consumption driving, or the like. Thus, light-emitting devices using light-emitting elements are expected to be widely used for various purposes, including new-generation mobile telephones and personal digital assistants (PDAs) and are attracting attention as the next-generation displays.

When displaying a multi-gray scale image using a light-emitting device with a self-light-emitting element, a current input method can be given as a driving method thereof. In the current input method, the luminance of the relevant light-emitting element is controlled by writing the current value form data onto the pixel as the image signal. It is possible that the image signal of the current input method is either an analog value (analog driving method) or a digital value (digital driving method).

As a signal line driver circuit with the above-mentioned current input system, for example, a circuit shown in FIG. 10A is proposed (refer to A. Yumoto et al., Proc. Asia Display/IDW '01 pp.1395–1398 (2001)). In FIG. 10A, a pair of current source circuits is provided to each of signal lines. In the structure of the circuit in FIG. 10A, pairs of current source circuits $A_1$ and $B_1$, $A_2$ and $B_2$, . . . are respectively connected with the signal lines. The pair of current source circuits A and B alternately conduct an operation of reading and storing an image signal in a form of a current value (image signal current) and an operation of writing a signal to a pixel through a signal line. That is, while the current source circuit A conducts the operation of reading and setting a signal current, the current source circuit B conducts the operation of writing a signal to a light-emitting element provided in a pixel region through a signal line. Conversely, while the current source circuit A conducts the operation of writing a signal to a light-emitting element provided in a pixel region through a signal line, the current source circuit B conducts the operation of reading and setting a signal current.

Operation timings of the current source circuits A and B are shown in FIG. 10B. FIG. 10B is a schematic block diagram of the following operation. In a k-th row selection period (horizontal period), while the circuit $A_1$ conducts the operation of reading and storing a signal ($R_1$), the circuit $B_1$ conducts the operation of writing a signal to a signal line ($W_1$). Further, in the next (k+1)-th row selection period, while the circuit $A_1$ conducts the operation of writing a signal to a signal line ($W_1$), the circuit $B_1$ conducts the operation of reading and storing a signal ($R_1$). Moreover, FIG. 10C is a schematic diagram of the entire light-emitting device provided with the current source circuit.

However, in the above-mentioned driver circuit, a pair of current source circuits is provided to each signal line. Thus, the area of the current source circuit shown in FIG. 10C is large, and miniaturization of the signal line driver circuit is difficult to be realized. As a result, in the light-emitting device, the proportion of the signal line driver circuit is large, which obstructs reduction in size of a frame and leads to reduction in area of the pixel region.

SUMMARY OF THE INVENTION

The present invention has been made in view of the above, and therefore has an object to provide a novel driving method for conducting gradation display with a circuit structure in which a current source circuit is provided to each signal line. Further, another object of the present invention is to attain miniaturization and reduction in size of a frame of a light-emitting device with the use of a signal line driver circuit that includes a current source circuit having a small area.

In order to solve the above-mentioned problems, according to the present invention, there is provided a driving method in which a period for reading and setting a signal (reading period) and a period for writing a set signal to a pixel (writing period) are separately provided in a selection period (horizontal period) for one row. Further, according to the present invention, provided is a light-emitting device with a structure in which a current source circuit is provided to each signal line.

In the present invention, first, the selection period (horizontal period) for one row is divided into plural periods. Then, in one of the divided periods, a (writing) operation of writing an image signal to a pixel from a current source circuit in a signal line driver circuit is performed in a certain column, while a (reading) operation of reading a signal current into a current source circuit in a signal line driver circuit is performed in another certain column. In another one of the divided periods, the reading operation is performed in the former certain column while the writing operation is performed in the latter certain column.

For example, a first scanning line (Ga) and a second scanning line (Gb) are provided. It is assumed that all the pixels each are provided with a pixel switch transistor for taking in an image signal to a pixel from a signal line and a current storage transistor. In this case, as to part of pixels in an arbitrary row, a gate of the current storage transistor of each of the pixels is connected with the second scanning line (Gb). It is assumed that, as to the other pixels in the line, a gate of the current storage transistor of each of the pixels is connected with a third scanning line (Gc). Also, it is assumed that the pixel switch transistor of each pixel is connected with the first scanning line (Ga). According to the present invention, the horizontal period is divided into a period for selecting the second scanning line (Gb) and a period for selecting the third scanning line (Gc). In the period for selecting the second scanning line (Gb), a (writing) operation of writing a signal to the pixel having the current storage transistor connected with the second scanning line (Gb) and a (reading) operation of reading an image signal current to the current source circuit of the signal line to the pixel having the current storage transistor connected with the third scanning line (Gc) that is not selected are performed simultaneously. Similarly, in the period for selecting the third scanning line (Gc), a (writing) operation of writing a signal to the pixel having the transistor connected with the third scanning line (Gc) and a (reading) operation of reading a signal current to the current source circuit connected with the signal line to the pixel having the current storage transistor connected with the second scanning line (Gb) that is not selected are performed simultaneously.

According to the driving method of the present invention, the proportion of the signal line driver circuit to the light-emitting device can be reduced, and thus, the reduction in size of a frame can be attained with a relatively large area of the pixel region to the light-emitting device.

Further, according to the present invention, provided is a light-emitting device in which each input line for an image signal current is shared by plural current source circuits. Thus, as to the light-emitting device, the number of input terminals (wirings) for image signals can be significantly reduced, and therefore, mounting of a peripheral IC chip becomes easy to be performed. Also, degradation in yield due to connection failure in a connecting portion of an FPC can be avoided.

Note that an organic compound layer in an organic light-emitting diode (OLED) in this specification indicates a layer containing an organic compound. The layer may be one containing an inorganic material, and further metal, metal complex, or the like. The category of the organic compound layer includes a hole injecting layer, a hole transporting layer, a light-emitting layer, a blocking layer, an electron transporting layer, an electron injecting layer, and the like.

BRIEF DESCRIPTION OF THE DRAWINGS

In the accompanying drawings:

FIGS. 10A to 10C are schematic diagrams of a conventional light-emitting device.

DETAILED DESCRIPTION OF THE PREFERRED EMBODIMENTS

Hereinafter, an embodiment mode of the present invention will be described based on the accompanying drawings. Note that, in all the figures for the description of the embodiment mode, identical parts are denoted by the same reference symbols, and repetition of explanation is omitted.

[Embodiment Mode 1]

Figure 5:
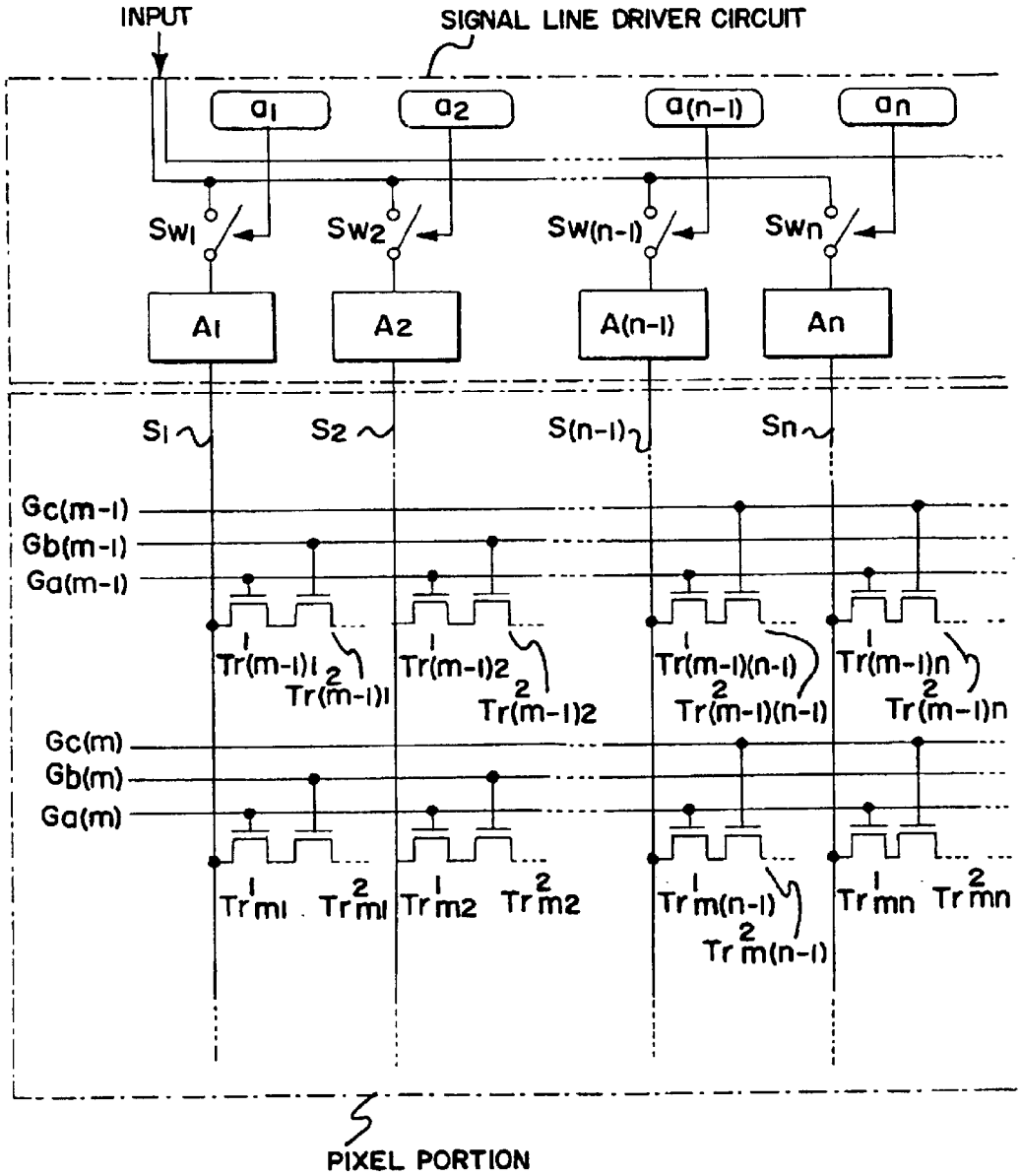
FIG. 5 is a diagram of a structure of the light-emitting device according to the present invention.

FIG. 5 shows an example of a signal line driver circuit according to the present invention. Note that FIG. 5 shows a peripheral portion of current source circuits $A_1, A_2, \ldots, A_{(n-1)}, A_n$.

The signal line driver circuit has the current source circuits $A_1, A_2, \ldots, A_{(n-1)}, A_n$ and an image signal input switches (Sw) on/off of which is controlled by control signals $a_1, a_2, \ldots, a_{(n-1)}, a_n$. The current source circuits $A_1, A_2, \ldots, A_{(n-1)}, A_n$ output an image signal current to signal lines $S_1, S_2, \ldots, S_{(n-1)}, S_n$, respectively. In a pixel portion, a first scanning line (Ga) and second and third scanning lines (Gb, Gc) are provided so as to be substantially perpendicular to the signal lines S, and pixels are arranged in matrix. Each of the pixels is provided with a pixel switch transistor ($Tr^1$) and a current storage transistor ($Tr^2$).

The current source circuits are connected with the signal lines and the image signal input switches (Sw), respectively. In each row, a gate electrode of each pixel switch transistor ($Tr^1$) is connected with the first scanning line (Ga) of the row, and a gate electrode of each current storage transistor ($Tr^2$) is connected with the second scanning line (Gb) or the third scanning line (Gc) of the row.

Figure 6A:
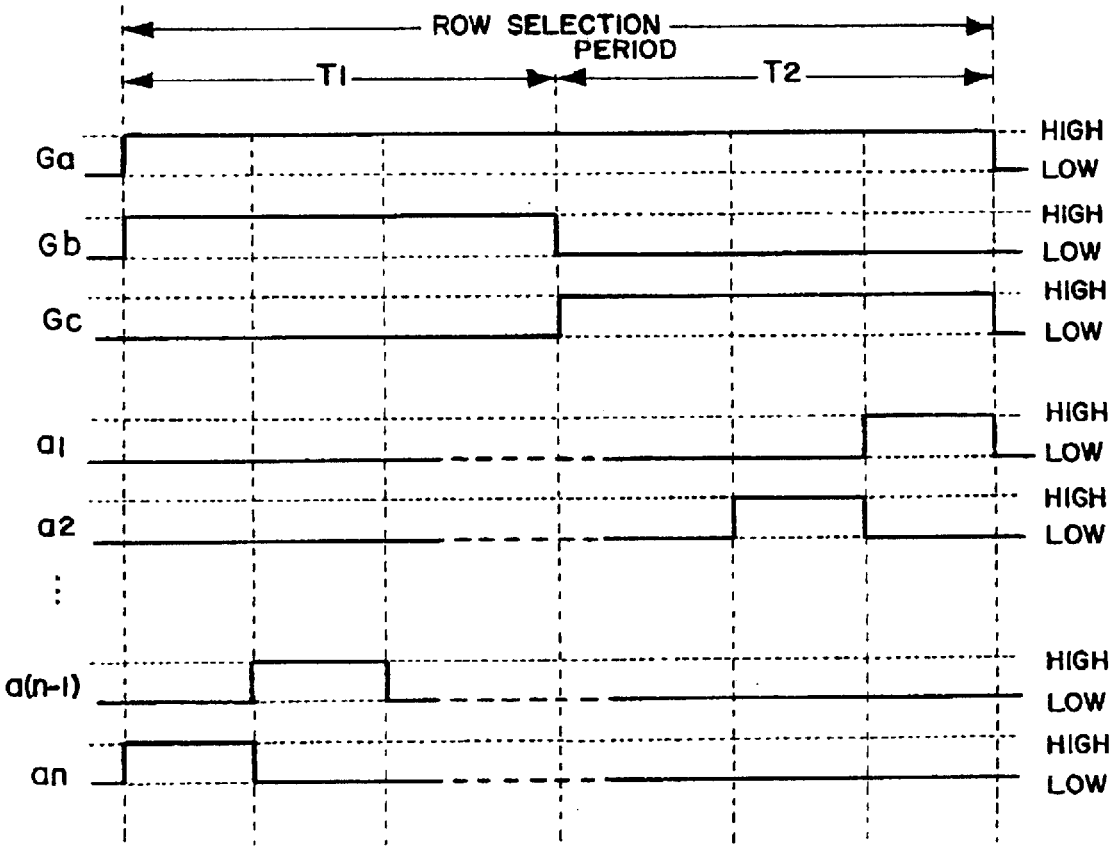
FIGS. 6A and 6B are diagrams of driving timings of the light-emitting device according to the present invention.
Figure 6B:
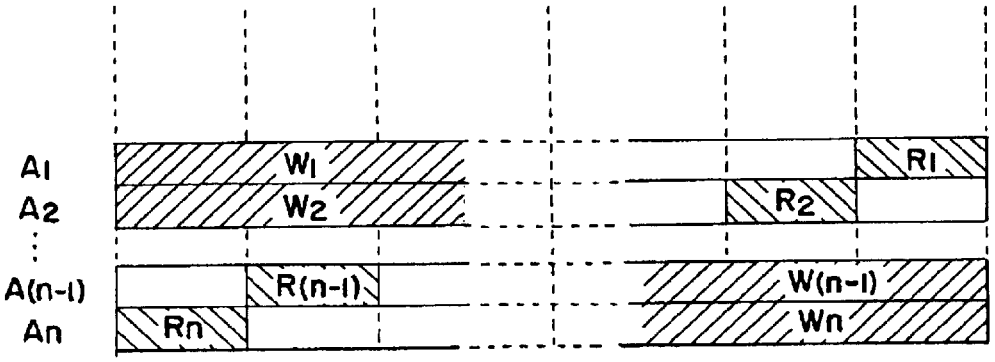

Next, a driving method of the above example will be described with reference to FIGS. 6A and 6B. FIG. 6A is a diagram showing timings of selection and non-selection (assumed that: High corresponds to selection and conduction; and Low corresponds to non-selection and insulation in this example) in a row selection period. FIG. 6B is a block diagram in which reading (R) to the current source circuits and writing (W) to light-emitting elements are shown.

As shown in FIG. 6A, the row selection period is divided into plural (two) periods such as T1 and T2. During one of the divided periods, for example, T1, a high signal is input to select the second scanning line (Gb). For example, in an m-th row selection period, the current storage transistors $Tr^2_{m1}$ and $T^2_{m2}$ connected to the second scanning line (Gb) are brought into an on state, and the image current is written into the pixels from the signal lines $S_1$ and $S_2$ connected with the transistors $Tr^1_{m1}$ and $Tr^1_{m2}$. (regions of $W_1$ and $W_2$ in FIG. 6B). At this time, the control signals $a_1$ and $a_2$ become signals that bring the image signal input switches (Sw) into an off state (Low), and the input signals are not read into the current source circuits $A_1$ and $A_2$. During T1, the current storage transistors $Tr^2_{m(n-1)}$ and $Tr^2_{mn}$ connected to the third scanning line (Gc) that is not selected (Low) are in an off state, and the signals are not written into the pixels. At this time, the control signals $a_{(n-1)}$ and $a_n$ sequentially become high signals to bring the switches into an on state, and the current is read into the current source circuits $A_{(n-1)}$ and $A_n$ (regions of $R_{(n-1)}$ and $R_n$ in FIG. 6B).

Further, during another period in the m-th row selection period, T2, a high signal is input to select the third scanning line (Gc). Then, the current storage transistors $Tr^2_{m(n-1)}$ and $Tr^2_{mn}$ connected to the third scanning line (Gc) are brought into an on state, and the image signal current is written into the pixels from the signal lines $S_{(n-1)}$ and $S_n$ connected to the transistors $Tr^2_{m(n-1)}$ and $Tr^2_{mn}$ (regions of $W_{(n-1)}$ and $W_n$ in FIG. 6B). At this time, the control signals $a_{(n-1)}$ and $a_n$ become low signals, and the input signals are not read into the current source circuits $A_{(n-1)}$ and $A_n$. During T2, the transistors $Tr^2_{m1}$ and $Tr^2_{m2}$ connected to the second scanning line (Gb) that is not selected (Low) are in an off state, and the image signals are not written into the pixels. At this time, the control signals $a_1$ and $a_2$ sequentially become high signals, and the current is read into the current source circuits $A_1$ and $A_2$ (regions of $R_1$ and $R_2$ in FIG. 6B).

Figure 7A:
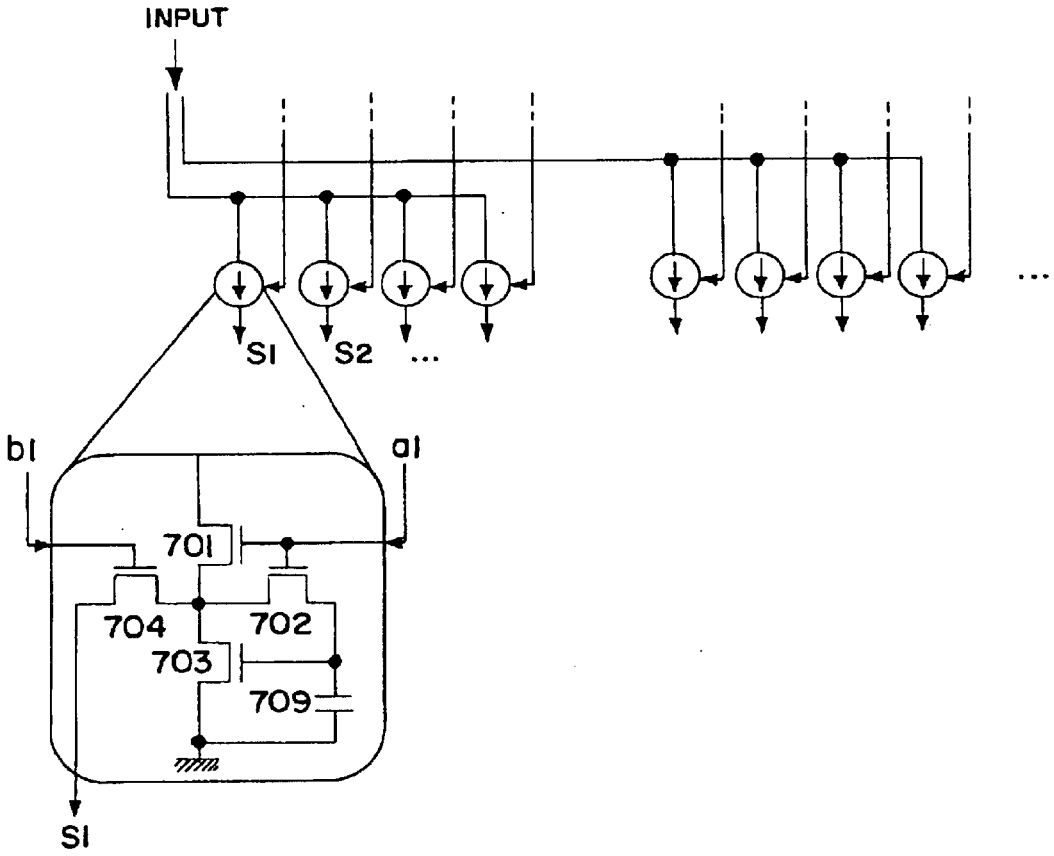
FIGS. 7A and 7B are schematic diagrams of current source circuits.
Figure 7B:
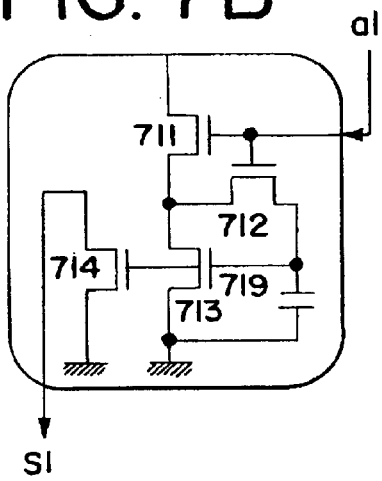

Next, description will be made of structural examples of the current source circuits. FIGS. 7A and 7B show examples of constant current sources provided in the current source circuits $A_1$, $A_2$, . . . . The current source circuits shown in FIGS. 7A and 7B are ones used on a low voltage side. However, the present invention is not limited to this. Further, since a source electrode and a drain electrode may be replaced with each other due to the polarity of a transistor and the voltage level, the source electrode or drain electrode of the transistor is referred to as a first electrode or second electrode.

First, description will be made of the circuit in FIG. 7A. The constant current source in FIG. 7A includes a first transistor 701, a second transistor 702, a third transistor 703, a fourth transistor 704, and a capacitor element 709 that holds a gate-source voltage of the third transistor 703. The first transistor 701 corresponds to each of the switches $Sw_1$, $Sw_2$, . . . $Sw_{(n-1)}$, and $Sw_n$, in FIG. 5.

A gate electrode of the first transistor 701 is connected with a gate electrode of the second transistor 702, and a first electrode of the first transistor 701 is connected with a second electrode of the second transistor 702, a first electrode of the third transistor 703, and a first electrode of the fourth transistor 704. A first electrode of the second transistor 702 is connected with a gate electrode of the third transistor 703. A second electrode of the fourth transistor 704 is connected with a signal line. A capacitor element 709 is connected between the gate electrode and a second electrode of the third transistor 703.

A signal current reading operation of the circuit is described. A control signal $a_n$, which is input to the respective gate electrodes of the first transistor 701 and the second transistor 702, brings the transistors into an on state. A signal current is made to flow to the third transistor 703 through the first transistor 701. At this time, the gate-source voltage and a source-drain voltage of the third transistor 703 are equal to each other. Thereafter, the first transistor 701 and the second transistor 702 are brought into an off state. Then, a current value of an image signal is stored as charge accumulated in the capacitor element 709, and thus, the third transistor 703 has an ability to make a signal current flow. Next, a signal current writing operation of the circuit is explained. A control signal $b_n$ that is input brings the fourth transistor 704 into an on state, and the signal current, which has been stored through the reading operation, is written into a signal line S1 from the third transistor 703 through the fourth transistor 704.

Sequentially, description will be made of the circuit in FIG. 7B. The current source circuit in FIG. 7B includes a first transistor 711, a second transistor 712, a third transistor 713 and a fourth transistor 714 that constitute a current mirror circuit, and a capacitor element 719 that holds a gate-source voltage of the third transistor. The first transistor 711 corresponds to the switch $Sw_1$ in FIG. 5. Note that the third transistor 713 and the fourth transistor 714 may have the same size.

A gate electrode of the first transistor 711 is connected with a gate electrode of the second transistor 712, and a first electrode of the first transistor 711 is connected with a second electrode of the second transistor 712 and a first electrode of the third transistor 713. A first electrode of the second transistor 712 is connected with a gate electrode of the third transistor 713. A first electrode of the fourth transistor 714 is connected with a signal line.

A signal current reading operation of the circuit is described. First, the control signal $a_n$, which is input to the respective gate electrodes of the first transistor 711 and the second transistor 712, brings the transistors into an on state. An image signal current is made to flow to the third transistor 713 through the first transistor. At this time, the gate-source voltage and a source-drain voltage of the third transistor 713 are equal to each other. Thereafter, the first transistor 711 and the second transistor 712 are brought into an off state. Then, a current value of an image signal is stored as charge accumulated in the capacitor element 719, and thus, the third transistor 713 and the fourth transistor 714 each have an ability to make a signal current flow. Next, a signal current writing operation of the circuit is explained. The signal current is written into the signal line S1 from the fourth transistor 714. Note that a fifth transistor may be provided between the fourth transistor 714 and the signal line to control a timing, at which the signal current flows to the signal line, with the control signal $b_n$.

The structural examples of the constant current source circuits of the present invention have been described above. However, the present invention is not limited to the structures, connections or operation methods of FIGS. 7A and 7B, and any circuit may be adopted as long as it is a circuit through which a constant current can be made to flow.

Figure 8A:
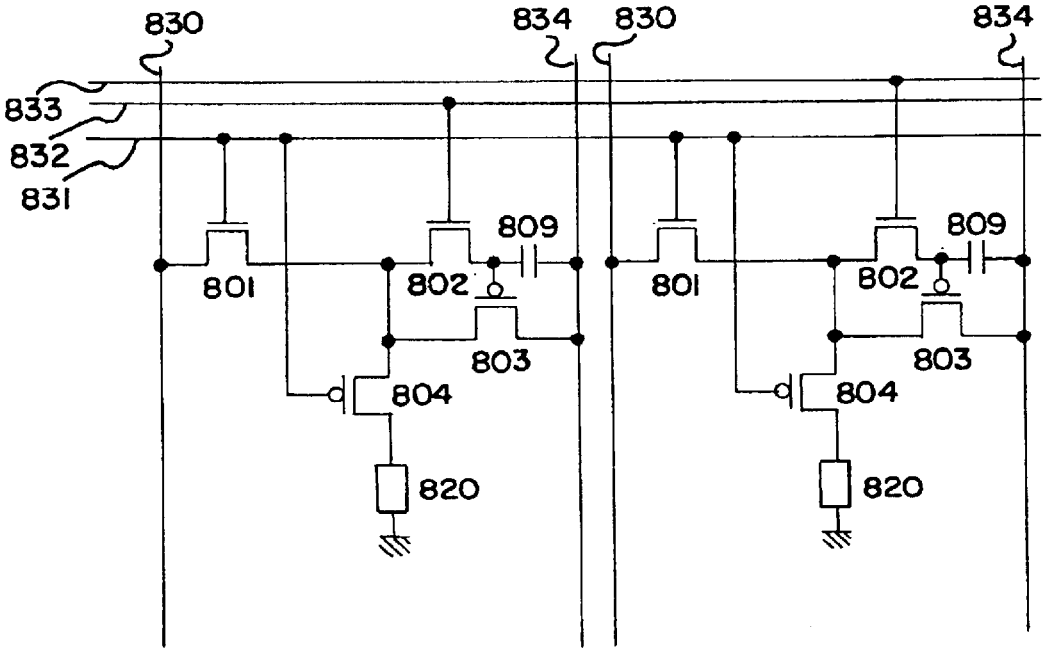
FIGS. 8A and 8B are schematic diagrams of pixel structures.
Figure 8B:
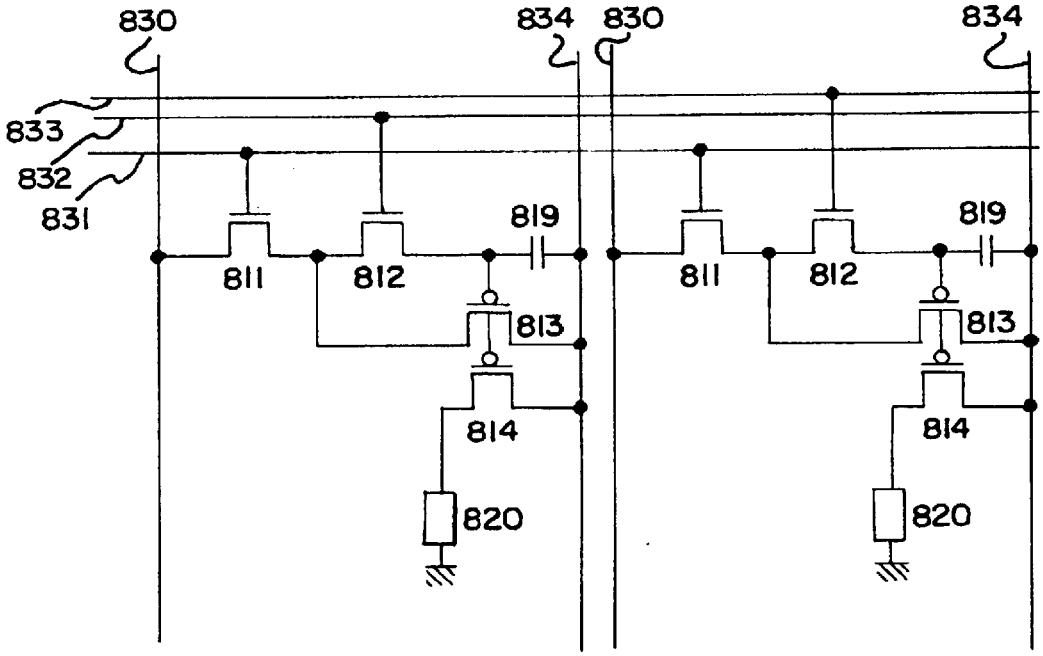

Next, description will be made of pixels according to the present invention. FIGS. 8A and 8B each show a structural example of adjacent two pixels. A pixel circuit of the present invention may be any one as long as it is of a system with which a signal current corresponding to an image signal can be stored and generated (referred to as current input system). Since the connection between a source electrode and a drain electrode may be changed due to the polarity of a transistor, the source electrode or drain electrode of the transistor is referred to as a first electrode or second electrode.

First, description will be made with reference to FIG. 8A. A pixel has a signal line 830, a first scanning line (Ga) 831, a second scanning line (Gb) 832, a third scanning line (Gc) 833, a power source line 834, a first transistor 801, a second transistor 802, a third transistor 803, a fourth transistor 804, a capacitor element 809, and a self-light-emitting element 820. The first transistor is a pixel switch transistor; the second transistor is a current storage transistor; and the fourth transistor is a transistor for driving a self-light-emitting element.

Gate electrodes of the first transistor 801 and the fourth transistor 804 are connected with the first scanning line (Ga) 831, a first electrode of the first transistor 801 is connected with the signal line 830, and a second electrode of the first transistor 801 is connected with a first electrode of the second transistor 802, a first electrode of the third transistor 803, and a first electrode of the fourth transistor 804. A gate electrode of the second transistor 802 is connected with the second scanning line (Gb) 832, and a second electrode of the second transistor 802 is connected with a gate electrode of the third transistor 803 and the capacitor element 809. A second electrode of the third transistor 803 is connected with the power source line 834. A second electrode of the fourth transistor 804 is connected with one of electrodes of the light-emitting element 820. The capacitor element 809 is arranged between the gate electrode and the second electrode of the third transistor, and holds a gate-source voltage of the fourth transistor 804. The power source line 834 and the other electrode of the light-emitting element 820 are set at predetermined potentials, respectively.

The adjacent pixel has a similar structure, but differs in the following point from the above pixel. That is, the point is that the gate electrode of the second transistor 802 is connected with the third scanning line (Gc) 833.

Further, in FIG. 8B, a pixel has the signal line 830, the first scanning line (Ga) 831, the second scanning line (Gb) 832, the third scanning line (Gc) 833, the power source line 834, a first transistor 811, a second transistor 812, a third transistor 813, a fourth transistor 814, a capacitor element 819, and the self-light-emitting element 820. The first transistor is the pixel switch transistor; the second transistor is the current storage transistor; and the fourth transistor is the transistor for driving a self-light-emitting element. Note that the third transistor 813 and the fourth transistor 814 may have the same size.

A gate electrode of the first transistor 811 is connected with the first scanning line (Ga) 831, a first electrode of the first transistor 811 is connected with the signal line 830, and a second electrode of the first transistor 811 is connected with a first electrode of the second transistor and a first electrode of the third transistor 813. A gate electrode of the second transistor 812 is connected with the second scanning line (Gb) 832, and a second electrode of the second transistor 812 is connected with gate electrodes of the third transistor 813 and the fourth transistor 814. A second electrode of the third transistor 813 and a first electrode of the fourth transistor are connected with the power source line 834. A second electrode of the fourth transistor is connected with one of electrodes of the light-emitting element 820. The capacitor element 819 is arranged between the gate electrode and the second electrode of the third transistor, and holds a gate-source voltage of the third transistor. The power source line 834 and the other electrode of the light-emitting element 820 are set at predetermined potentials, respectively.

The adjacent pixel has a similar structure, but differs in the following point from the above pixel. That is, the point is that the gate electrode of the second transistor 802 is connected with the third scanning line (Gc) 833.

From the above, the pixels of the example in FIGS. 8A or 8B have characteristics that the gate electrode of the second transistor is connected with either the second scanning line (Gb) or the third scanning line (Gc).

As described above, according to the present invention, it is characterized in that: a gate selection period is divided into plural periods, for example, T1 and T2; and both the (writing) operation of writing a signal to the pixel having the transistor connected with the scanning line that is selected and the (reading) operation of reading a signal current to the current source circuit connected with the signal line connected with the scanning line that is not selected are performed during T1 or T2 in the same row selection period. According to the driving method of the present invention, the area of the signal line driver circuit can be reduced, and thus, miniaturization of a light-emitting device can be realized. Moreover, in the light-emitting device, reduction in size of a frame can be attained, which means the proportion of the signal line driver circuit is small while the proportion of the pixel region is large.

Furthermore, in this embodiment mode, each input line for image signals is shared by the plural current source circuits, and thus, the number of terminals for taking in the image signals from the outside can be significantly reduced. As a result of the reduction in the number of connection terminals with respect to the outside, degradation in yield due to connection failure can also be avoided.

Embodiments

Hereinafter, the present invention will be specifically described based on embodiments.

[Embodiment 1]

In this embodiment, description will be made of a structure and a driving method in the case where each input line for an image signal current is shared by four current source circuits. Also, the circuits described with reference to FIGS. 7A and 7B and FIGS. 8A and 8B may be used for a pixel structure and a constant current source in this embodiment. However, the present invention is not limited to the circuits in FIGS. 7A and 7B and FIGS. 8A and 8B.

Figure 1:
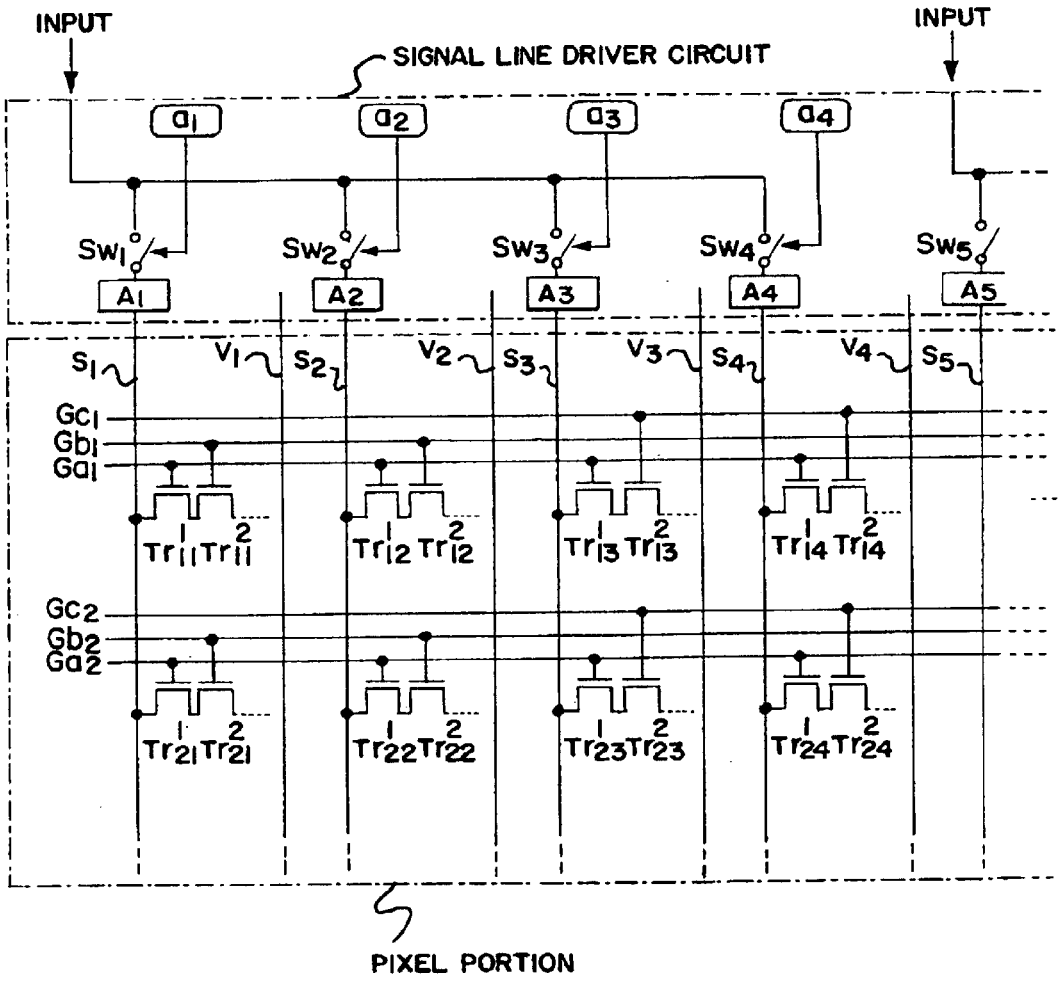
FIG. 1 is a diagram of a structure of a light-emitting device according to the present invention.

FIG. 1 shows a structure in which each input line for image signals is shared by four current source circuits. In FIG. 1, current source circuits $A_1$, $A_2$, . . . , image signal input switches $Sw_1$, $Sw_2$, . . . on/off of which is controlled by control signals $a_1$, $a_2$, . . . , and signal lines $S_1$, $S_2$, . . . are provided. Then, the first scanning line (Ga) and the second and third scanning lines (Gb), (Gc) are provided so as to be substantially perpendicular to the respective signal lines, and each pixel is arranged at an intersecting point of the signal line and the first scanning line (Ga) or the second and third scanning lines (Gb), (Gc). In each pixel, pixel switch transistors $Tr^1_{11}$, $Tr^1_{12}$, . . . and current storage transistors $Tr^2_{11}$, $Tr^2_{12}$, . . . are provided.

Each of the current source circuits in the signal line driver circuit is connected with the signal line and the image signal input switch. Gate electrodes of the current storage transistors $Tr^2_{11}$ and $Tr^2_{12}$ are connected with the second scanning line (Gb), and gate electrodes of the current storage transistors $Tr^2_{13}$ and $Tr^2_{14}$ are connected with the third scanning line (Gc). First electrodes (source electrodes or drain electrodes) of the pixel switch transistors $Tr^1_{11}$, $Tr^1_{12}$, $Tr^1_{13}$, and $Tr^1_{14}$ are connected with the respective signal lines $S_1$, $S_2$, $S_3$, and $S_4$, and gate electrodes thereof are connected with the first scanning line (Ga). In addition, the current source circuits $A_1$, $A_2$, $A_3$, and $A_4$ are connected with one image signal current input line through the respective switches.

Figure 2A:
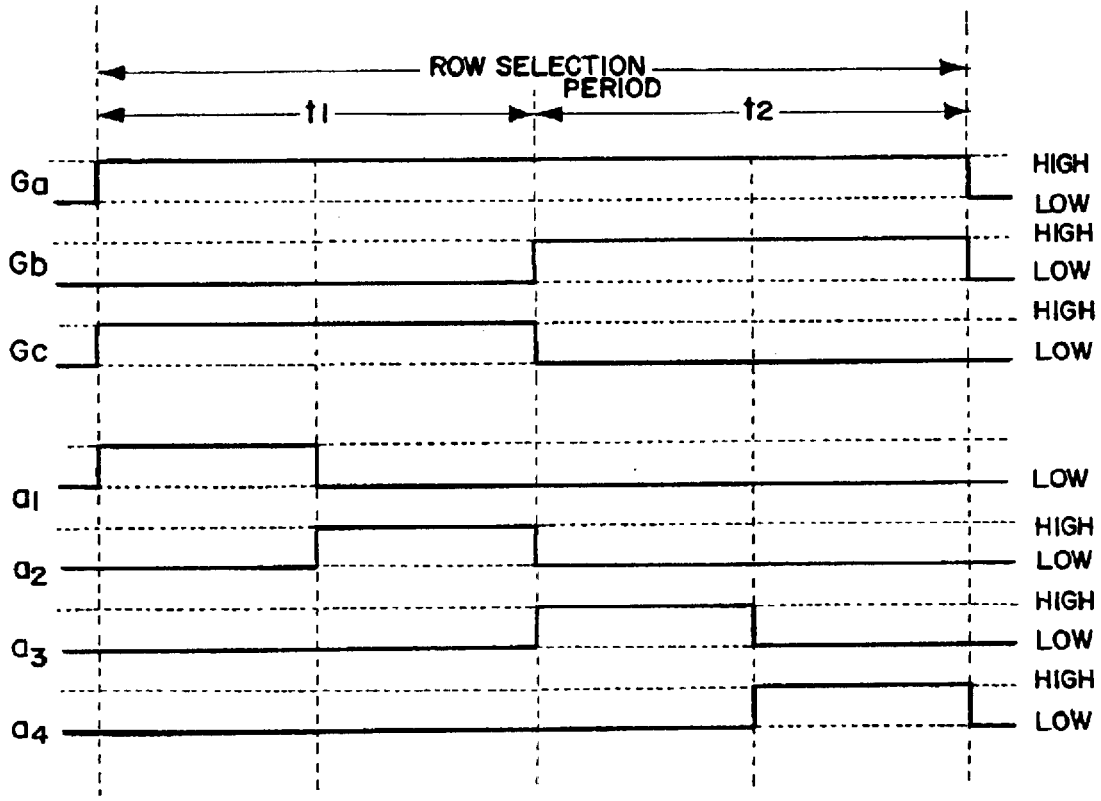
FIGS. 2A and 2B are diagrams of driving timings of the light-emitting device according to the present invention.
Figure 2B:
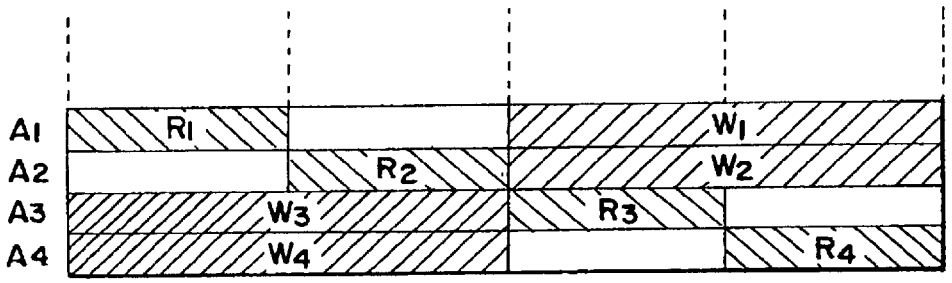

Next, the driving method of the present invention will be described with reference to FIGS. 2A and 2B. The description is made for a first column through a fourth column in a first row, but the same goes for and the other rows. FIG. 2A is a diagram showing timings of selection and non-selection (assumed that: High corresponds to selection and conduction; and Low corresponds to non-selection and insulation in this example) in a row selection period. FIG. 2B is a block diagram in which reading (R) to the current source circuits in the signal line driver circuit and writing (W) to the pixels from the current source circuits are shown.

As shown in FIG. 2A, the row selection period is divided into t1 and t2. In the first-row selection period, the first scanning line (Ga) in the row is at High through t1 and t2, and the pixel switch transistors $Tr^1_{11}$, $Tr^1_{12}$, $Tr^1_{13}$, and $Tr^1_{14}$ are in an on state. Durin the period of t1, a high signal is input to the third scanning line (Gc) in the state in which a low signal is input to the second scanning line (Gb). Therefore, the transistors $Tr^2_{13}$ and $Tr^2_{14}$ connected to the third scanning line (Gc) are brought into an on state, and such a state is brought about in which the image signal current can be stored into the pixels from the signal lines $S_3$ and $S_4$ (regions of $W_3$ and $W_4$ in FIG. 2B). At this time, the control signals $a_3$ and $a_4$ become signals that bring the image signal input switches into an off state (Low), and the image signals are not read into the current source circuits $A_3$ and $A_4$. During t1, the transistors $Tr^2_{11}$, and $Tr^2_{12}$ connected to the second scanning line (Gb) that is not selected (Low) are in an off state, and the image signal current is not stored into the pixels. At this time, the control signals $a_1$ and $a_2$ are at High, and bring the image signal input switches into an on state. The image signal current is read into the current source circuits $A_1$ and $A_2$ (regions of $R_1$ and $R_2$ in FIG. 2B).

Further, during t2, a high signal is input to the second scanning line (Gb) in the state in which a low signal is input to the third scanning line (Gc). Therefore, the transistors $Tr^2_{11}$ and $Tr^2_{12}$ connected with the second scanning line (Gb) are brought into an on state, and such a state is brought about in which the image signal current can be stored into the pixels from the signal lines $S_1$ and $S_2$ (regions of $W_1$ and $W_2$ in FIG. 2B). At this time, the control signals $a_1$ and $a_2$ become signals that bring the switches into an off state (Low), and the input signals are not read into the current source circuits $A_1$ and $A_2$. During t2, the transistors $Tr^2_{13}$ and $Tr^2_{14}$ connected to the third scanning line (Gc) that is not selected (Low) are in an off state, and the image signal current is not stored into the pixels. At this time, the control signals $a_3$ and $a_4$ are at High, and bring the image signal input switches into an on state. The current is read into the current source circuits $A_3$ and $A_4$ (regions of $R_3$ and $R_4$ in FIG. 2B).

As described above, according to the present invention, it is characterized in that: the row selection period is divided into plural periods (two of t1 and t2 in this embodiment); and the (writing) operation of writing the image signal current to the pixel and the (reading) operation of reading the signal current to the current source circuit in the signal line driver circuit are performed during the same row selection period. According to the driving method of the present invention, the area of the signal line driver circuit can be reduced, and thus, miniaturization of a light-emitting device can be realized. Moreover, in the light-emitting device, reduction in size of a frame can be attained, which means the proportion of the signal line driver circuit is small while the proportion of the pixel region is large.

Furthermore, in this embodiment, each input line for image signals is shared by the plural current source circuits, and thus, the number of terminals for taking in the image signals from the outside can be significantly reduced. As a result of the reduction in the number of connection terminals with respect to the outside, degradation in yield due to connection failure can also be avoided.

[Embodiment 2]

In this embodiment, description will be made of a structure and a driving method in the case where each input line for an image signal is shared by eight current source circuits. Also, the circuits described with reference to FIGS. 7A and 7B and FIGS. 8A and 8B are used for a pixel structure and a constant current source in this embodiment. However, the present invention is not limited to the circuits in FIGS. 7A and 7B and FIGS. 8A and 8B.

Figure 3:
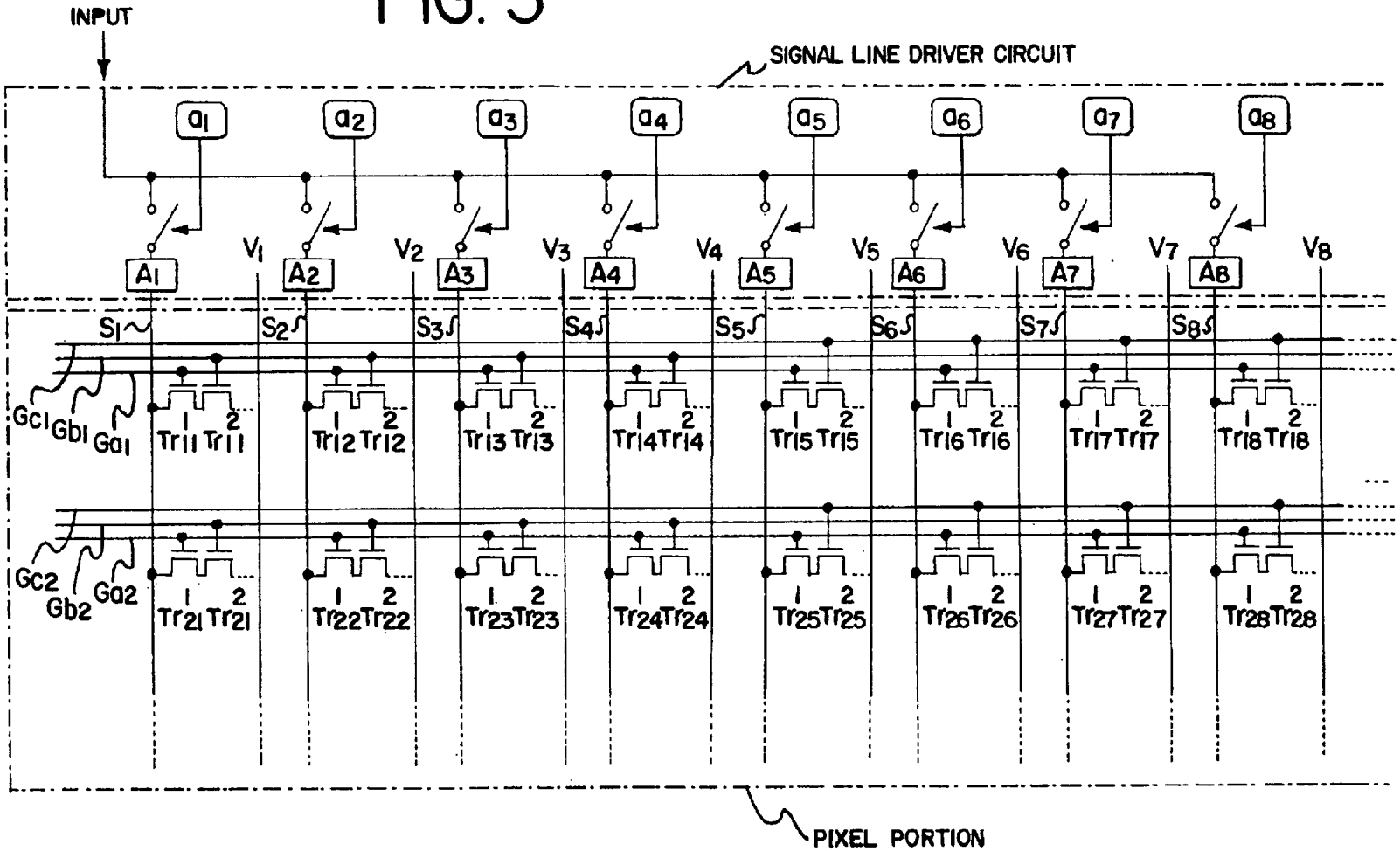
FIG. 3 is a diagram of a structure of the light-emitting device according to the present invention.

FIG. 3 shows a structure in which each input line for image signals is shared by eight current source circuits. In FIG. 3, current source circuits $A_1$, $A_2$, . . . , image signal input switches on/off of which is controlled by control signals $a_1$, $a_2$, . . . , and signal lines $S_1$, $S_2$, . . . are provided. Then, the first scanning line (Ga) and the second and third scanning lines (Gb), (Gc) are provided so as to be substantially perpendicular to the respective signal lines, and each pixel is arranged at an intersecting point of the signal line and the first scanning line (Ga) or the second and third scanning lines (Gb), (Gc). In each pixel, pixel switch transistors $Tr^1_{11}$, $Tr^1_{12}$, . . . and current storage transistors $Tr^2_{11}$, $Tr^2_{12}$, . . . are provided.

Each of the current source circuits in the signal line driver circuit is connected with the signal line and the image signal input switch. Gate electrodes of the current storage transistors $Tr^2_{11}$, $Tr^2_{12}$, $Tr^2_{13}$, $Tr^2_{14}$ are connected with the second scanning line (Gb), and gate electrodes of the current storage transistors $Tr^2_{15}$, $Tr^2_{16}$, $Tr^2_{17}$, $Tr^2_{18}$ are connected with the third scanning line (Gc). First electrodes (source electrodes or drain electrodes) of the pixel switch transistors $Tr^1_{11}$, $Tr^1_{12}$, . . . , $Tr^1_{17}$, $Tr^1_{18}$ are connected with the respective signal lines $S_1$, $S_2$, . . . , $S_7$, $S_8$, and gate electrodes thereof are connected with the first scanning line (Ga). In addition, the current source circuits $A_1$, $A_2$, . . . , $A_7$, $A_8$ are connected with one image signal current input line through the respective switches.

Figure 4A:
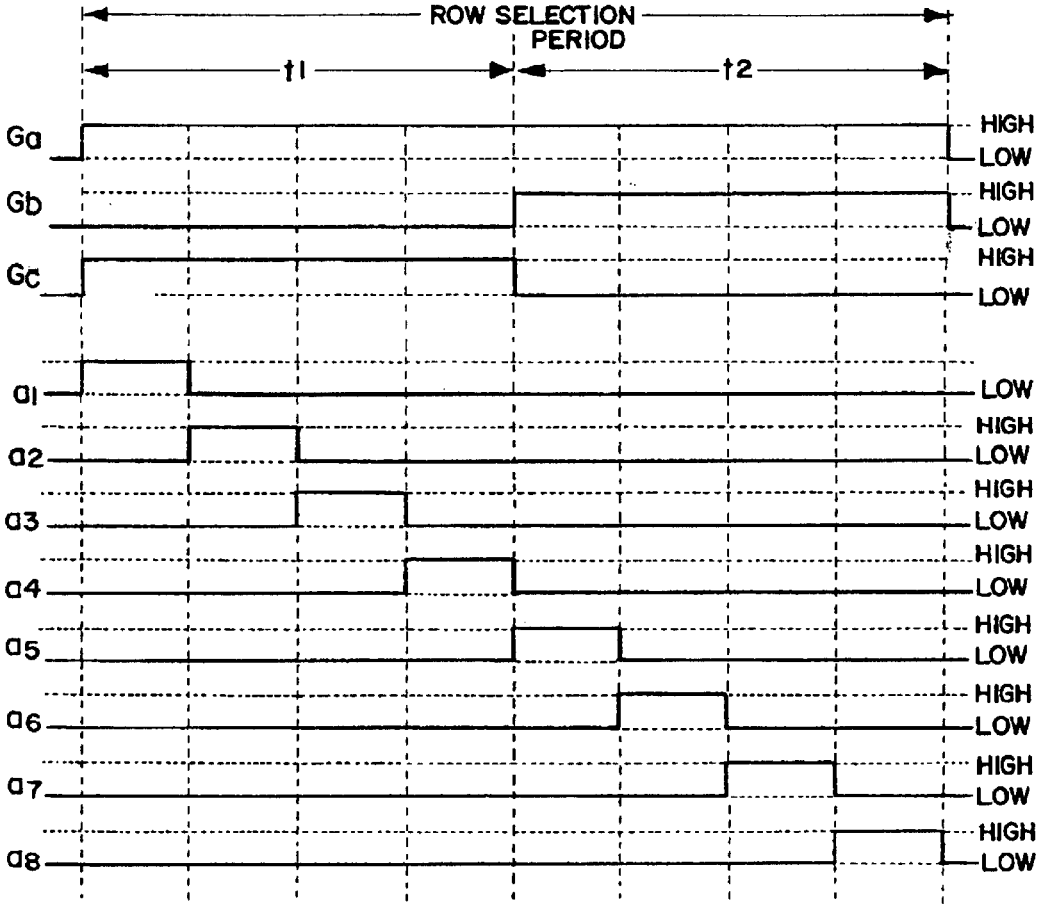
FIGS. 4A and 4B are diagrams of driving timings of the light-emitting device according to the present invention.
Figure 4B:
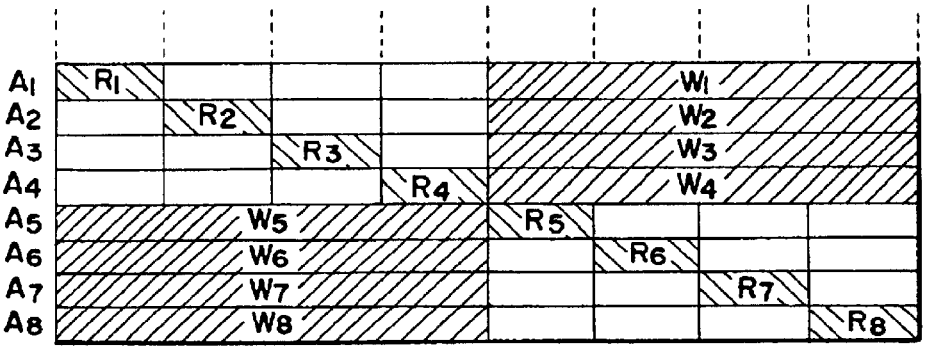

Next, the driving method of the present invention will be described with reference to FIGS. 4A and 4B. The description is made only for a first column through an eighth column in a first row, but the same goes for the other columns and the other rows. FIG. 4A is a diagram showing timings of selection and non-selection (assumed that: High corresponds to selection and conduction; and Low corresponds to non-selection and insulation in this example) in a row selection period. FIG. 4B is a block diagram in which reading (R) to the current source circuits in the signal line driver circuit and writing (W) to the pixels from the current source circuits are shown.

As shown in FIG. 4A, the row selection period is divided into t1 and t2. In the first-row selection period, the first scanning line (Ga) in the row is at High through t1 and t2, and the pixel switch transistors $Tr^1_{11}$, $Tr^1_{12}$, . . . , $Tr^1_{17}$, $Tr^1_{18}$ are in an on state. During the period of t1, a high signal is input to the third scanning line (Gc) in the state in which a low signal is input to the second scanning line (Gb). Therefore, the transistors $Tr^2_{15}$, $Tr^2_{16}$, $Tr^2_{17}$, $Tr^2_{18}$ connected to the third scanning line (Gc) are brought into an on state, and such a state is brought about in which the image signal current can be stored into the pixels from the signal lines $S_5$, $S_6$, $S_7$, $S_8$ (regions of $W_5$, $W_6$, $W_7$, $W_8$ in FIG. 4B). At this time, the control signals $a_5$, $a_6$, $a_7$, $a_8$ become signals that bring the image signal input switches into an off state (Low), and the image signals are not read into the current source circuits $A_5$, $A_6$, $A_7$, $A_8$. During t1, the transistors $Tr^2_{11}$, $Tr^2_{12}$, $Tr^2_{13}$, $Tr^2_{14}$ connected to the second scanning line (Gb) that is not selected (Low) are in an off state, and the image signal current is not stored into the pixels. At this time, the control signals $a_1$, $a_2$, $a_3$, $a_4$ are at High, and bring the image signal input switches into an on state. The image signal current is read into the current source circuits $A_1$, $A_2$, $A_3$, $A_4$ (regions of $R_1$, $R_2$, $R_3$, $R_4$ in FIG. 4B).

Further, during t2, a high signal is input to the second scanning line (Gb) in the state in which a low signal is input to the third scanning line (Gc). Therefore, the transistors $Tr^2_{11}$, $Tr^2_{12}$, $Tr^2_{13}$, $Tr^2_{14}$ connected with the second scanning line (Gb) are brought into an on state, and such a state is brought about in which the image signal current can be stored into the pixels from the signal lines $S_1$, $S_2$, $S_3$, $S_4$ (regions of $W_1$, $W_2$, $W_3$, $W_4$ in FIG. 4B). At this time, the control signals $a_1$, $a_2$, $a_3$, $a_4$ become signals that bring the switches into an off state (Low), and the input signals are not read into the current source circuits $A_1$, $A_2$, $A_3$, $A_4$. During t2, the transistors $Tr^2_{15}$, $Tr^2_{16}$, $Tr^2_{17}$, $Tr^2_{18}$ connected to the third scanning line (Gc) that is not selected (Low) are in an off state, and the image signal current is not stored into the pixels. At this time, the control signals $a_5$, $a_6$, $a_7$, $a_8$ are at High, and bring the image signal input switches into an on state. The current is read into the current source circuits $A_5$, $A_6$, $A_7$, $A_8$ (regions of $R_5$, $R_6$, $R_7$, $R_8$ in FIG. 4B).

As described above, according to the present invention, it is characterized in that: the row selection period is divided into plural periods (two of t1 and t2 in this embodiment); and the (writing) operation of writing the image signal current to the pixel and the (reading) operation of reading the signal current to the current source circuit in the signal line driver circuit are performed during the same row selection period. According to the driving method of the present invention, the area of the signal line driver circuit can be reduced, and thus, miniaturization of a light-emitting device can be realized. Moreover, in the light-emitting device, reduction in size of a frame can be attained, which means the proportion of the signal line driver circuit is small while the proportion of the pixel region is large.

Furthermore, in this embodiment, each input line for image signals is shared by the plural current source circuits, and thus, the number of terminals for taking in the image signals from the outside can be significantly reduced. As a result of the reduction in the number of connection terminals with respect to the outside, degradation in yield due to connection failure can also be avoided.

[Embodiment 3]

Figure 9A:
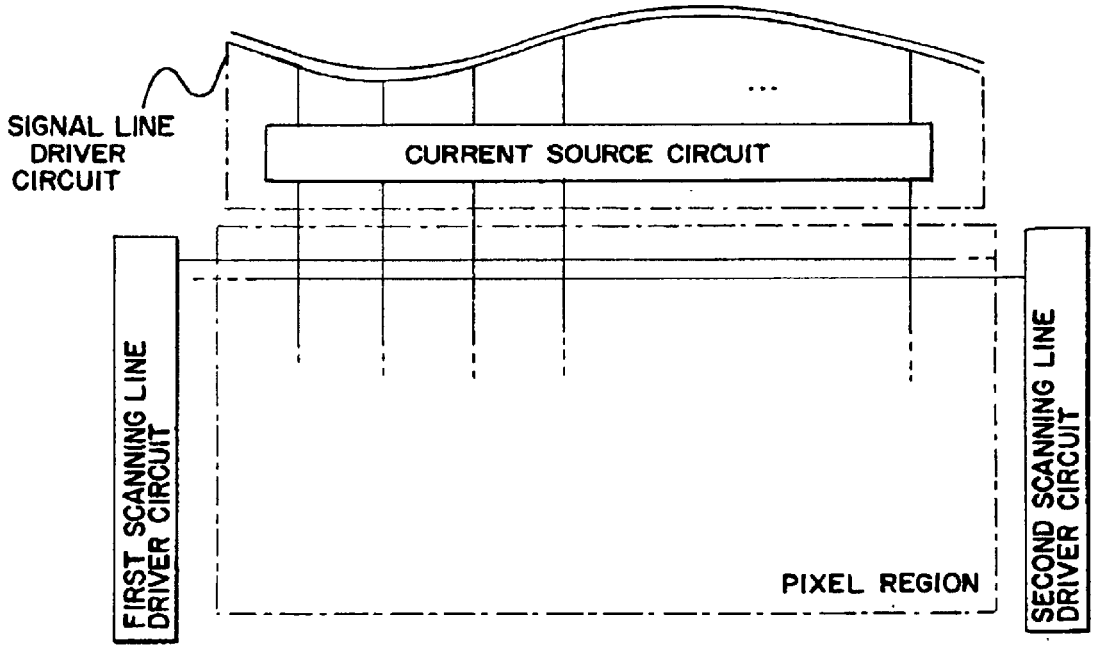
FIGS. 9A and 9B are schematic diagrams of the light-emitting device according to the present invention.
Figure 9B:
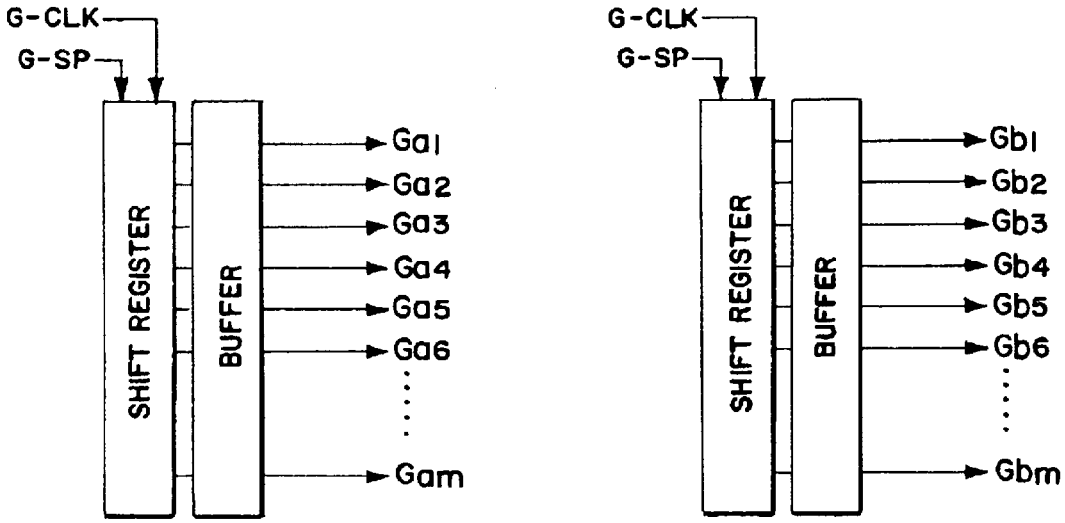

FIGS. 9A and 9B are schematic diagrams of a light-emitting device that uses the present invention. FIG. 9A shows the light-emitting device that includes: a pixel region in which pixels provided with light-emitting elements are arranged in matrix; a signal line driver circuit having a current source circuit; a first scanning line driver circuit; and a second scanning line driver circuit. The first scanning line driver circuit is connected with the first scanning line (Ga), and the second scanning line driver circuit is connected with the second scanning line (Gb). Note that the first and second scanning line driver circuits may be provided on the same side with respect to the pixel region, although being arranged symmetrically, while sandwiching the pixel region.

The structures of the first scanning line driver circuit and the second scanning line driver circuit are described with reference to FIG. 9B. The first scanning line driver circuit and the second scanning line driver circuit each have a shift register and a buffer. An operation thereof is simply explained. The shift register sequentially outputs sampling pulses in accordance with a clock signal (G-CLK), a start pulse (S-SP), and a clock inversion signal (G-CLKb). Thereafter, the sampling pulses amplified by the buffer are input to the scanning lines to select rows on a one-by-one basis. Then, the signal current is sequentially written from the signal line into the pixel controlled by the selected scanning line.

Such a structure may be adopted in which a level shifter circuit is arranged between the shift register and the buffer. Voltage amplitude can be extended by additionally arranging the level shifter circuit.

According to the driving method of the present invention, the area of the signal line driver circuit, particularly the area of the current source circuit can be reduced. Note that the number of scanning line driver circuits is increased to two, but the area of the scanning line driver circuit is small compared with the area of the signal line driver circuit. Therefore, miniaturization, reduction in weight, and reduction in size of a frame of the light-emitting device can be attained.

Furthermore, plural signal line driver circuits may be provided in order to more speedily conduct the (writing) operation of writing the image signal current to the pixel and the (reading) operation of reading the signal current to the current source circuit.

[Embodiment 4]

Given as examples of electronic apparatuses using a light-emitting device of the present invention include a video camera, a digital camera, a goggles-type display (head mount display), a navigation system, a sound reproduction device (such as a car audio equipment and an audio set), a lap-top computer, a game machine, a portable information terminal (such as a mobile computer, a mobile telephone, a portable game machine, and an electronic book), an image reproduction apparatus including a recording medium (more specifically, an apparatus which can reproduce a recording medium such as a digital versatile disc (DVD) and so forth, and includes a display for displaying the reproduced image), or the like. In particular, in the case of the portable information terminal, use of the light-emitting device is preferable, since the portable information terminal that is likely to be viewed from a tilted direction is often required to have a wide viewing angle. FIGS. 11A to 11H respectively shows various specific examples of such electronic apparatuses.

Figure 11A:
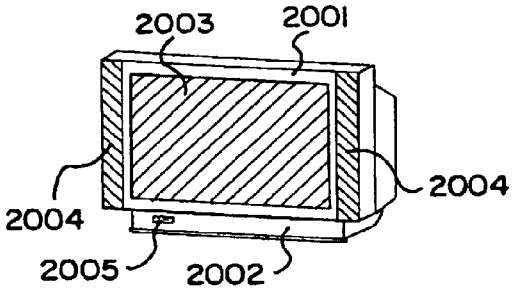
FIGS. 11A to 11H are diagrams of electronic equipments each of which uses the light-emitting device according to the present invention.

FIG. 11A illustrates a light-emitting device which includes a casing 2001, a support table 2002, a display portion 2003, a speaker portion 2004, a video input terminal 2005 and the like. The present invention is applicable to the display portion 2003. Also, the light-emitting device shown in FIG. 11A is completed by the present invention. The light-emitting device is of the self-emission-type and therefore requires no backlight. Thus, the display portion thereof can have a thickness thinner than that of the liquid crystal display device. The light-emitting device is including the entire display device for displaying information, such as a personal computer, a receiver of TV broadcasting and an advertising display.

Figure 11B:
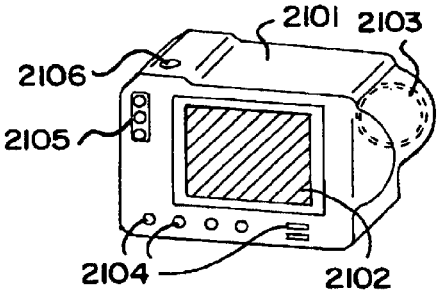

FIG. 11B illustrated a digital still camera which includes a main body 2101, a display portion 2102, an image receiving portion 2103, an operation key 2104, an external connection port 2105, a shutter 2106, and the like. The light-emitting device of the present invention can be used as the display portion 3102. Also, the digital still camera shown in FIG. 11B is completed by the present invention.

Figure 11C:
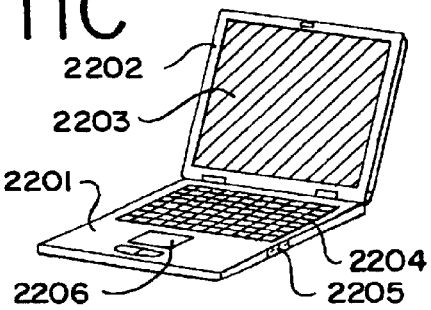

FIG. 11C illustrates a lap-top computer which includes a main body 2201, a casing 2202, a display portion 2203, a keyboard 2204, an external connection port 2205, a pointing mouse 2206, and the like. The light-emitting device of the present invention can be used as the display portion 2203. Also, the lap-top computer shown in FIG. 11C is completed by the present invention.

Figure 11D:
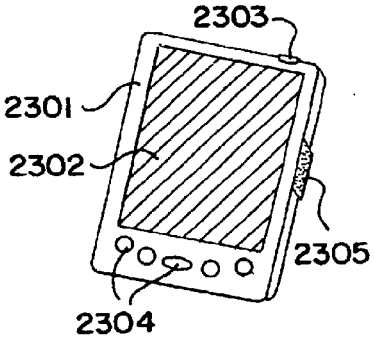

FIG. 11D illustrated a mobile computer which includes a main body 2301, a display portion 2302, a switch 2303, an operation key 2304, an infrared port 2305, and the like. The light-emitting device of the present invention can be used as the display portion 2302. The mobile computer shown in FIG. 11D is completed by the present invention.

Figure 11E:
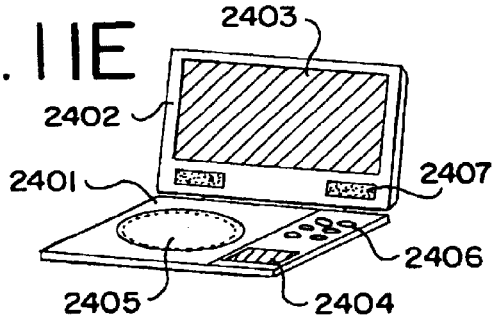

FIG. 11E illustrates a portable image reproduction apparatus including a recording medium (more specifically, a DVD reproduction apparatus), which includes a main body 2401, a casing 2402, a display portion A 2403, another display portion B 2404, a recording medium (DVD or the like) reading portion 2405, an operation key 2406, a speaker portion 2407 and the like. The display portion A 2403 is used mainly for displaying image information, while the display portion B 2404 is used mainly for displaying character information. The light-emitting device of the present invention can be used as these display portions A 2403 and B 2404. The image reproduction apparatus including a recording medium further includes a domestic game machine or the like. Also, the portable image reproduction apparatus shown in FIG. 11E is completed by the present invention.

Figure 11F:
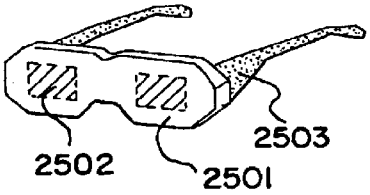

FIG. 11F illustrates a goggle type display (head mounted display) which includes a main body 2501, a display portion 2502, arm portion 2503, and the like. The light-emitting device of the present invention can be used as the display portion 2502. Also, the goggle type display shown in FIG. 11F is completed by the present invention.

Figure 11G:
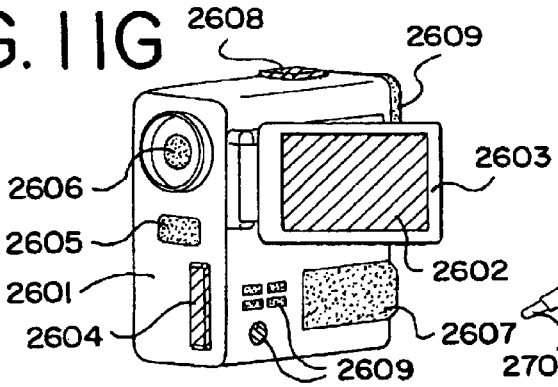

FIG. 11G illustrates a video camera which includes a main body 2601, a display portion 2602, a casing 2603, an external connecting port 2604, a remote control receiving portion 2605, an image receiving portion 2606, a battery 2607, a sound input portion 2608, an operation key 2609, and the like. The light-emitting device of the present invention can be used as the display portion 2602. Also, the video camera shown in FIG. 11G is completed by the present invention.

Figure 11H:
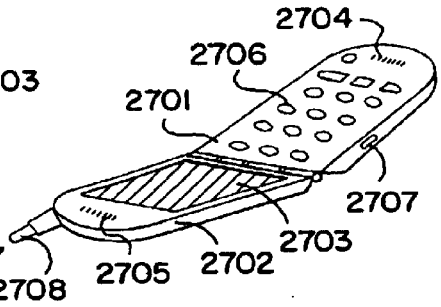

FIG. 11H illustrates a mobile telephone which includes a main body 2701, a casing 2702, a display portion 2703, a sound input portion 2704, a sound output portion 2705, an operation key 2706, an external connecting port 2707, an antenna 2708, and the like. The light-emitting device of the present invention can be used as the display portion 2703. Note that the display portion 2703 can reduce power consumption of the mobile telephone by displaying white-colored characters on a black-colored background. Also, the mobile telephone shown in FIG. 11H is completed by the present invention.

When a brighter luminance of light-emitting materials becomes available in the future, the light-emitting device in accordance with the present invention will be applicable to a front-type or rear-type projector in which light including output image information is enlarged by means of lenses or the like to be projected.

The aforementioned electronic apparatuses are more likely to be used for display information distributed through a telecommunication path such as Internet, a CATV (cable television system), and in particular likely to display moving picture information. The light-emitting device is suitable for displaying moving pictures since the organic light-emitting material can exhibit high response speed.

A portion of the light-emitting device that is emitting light consumes power, so it is desirable to display information in such a manner that the light-emitting portion therein becomes as small as possible. Accordingly, when the light-emitting device is applied to a display portion which mainly displays character information, e.g., a display portion of a portable information terminal, and more particular, a portable telephone or a sound reproduction device, it is desirable to drive the light-emitting device so that the character information is formed by a light-emitting portion while a non-emission portion corresponds to the background.

As set forth above, the present invention can be applied variously to a wide range of electronic apparatuses in all fields. Moreover, the electronic apparatuses in this embodiment can be implemented by using any structure of the signal line drive circuit in Embodiments 1 to 3.

According to the present invention, one current source circuit in the signal line driver circuit is provided for each column. Then, the row selection period (horizontal period) is divided into plural periods. In each of the divided periods, the (writing) operation of writing the image signal current to the pixel is performed in a certain column of the row while the (reading) operation of reading the image signal current to the current source circuit in the signal line driver circuit in another column of the row. The columns for conducting the writing operation and the reading operation differ for each divided period. As described above, the number of current source circuits in the signal line driver circuit is limited to one for each column. Thus, the signal line driver circuit that includes the current source circuit having a small area can be provided, and therefore, the reduction in size of the frame of the light-emitting device can be attained.

Further, according to the present invention, the image signal current input line is shared by the plural current source circuits in the signal line driver circuit. Thus, the number of terminals for taking in the image signals from the outside can be reduced. As a result of the reduction in the number of the connection terminals with respect to the outside, the degradation in yield due to connection failure can also be avoided.

What is claimed is:

1. A light-emitting device comprising:

a scanning line driver circuit;

plural scanning lines;

plural signal lines; and plural pixels;

wherein the plural pixels each is provided with a self-light-emitting element, wherein the plural signal lines each is connected with a current source circuit, wherein the scanning line driver circuit selects a scanning line for inputting a current to pixels and the scanning line for reading a current source circuit in the same gate selection period.

2. The light-emitting device according to claim 1, wherein the self-light-emitting element is an OLED.

3. A light-emitting device according to claim 1, wherein the current source circuit is formed in a signal line driver circuit.

4. The light-emitting device according to claim 1, wherein the light-emitting device is incorporated into an electronic apparatus selected from the group consisting of a video camera, a digital camera, a goggles-type display, a navigation system, a sound reproduction device, a lap-top computer, a game machine, a portable information terminal, an image reproduction apparatus.

5. A light-emitting device comprising:

a first scanning line driver circuit;

a second scanning line driver circuit;

a pixel region; and a signal line driver circuit that includes a current source circuit, wherein the first scanning line driver circuit has a function of selecting a scanning line for inputting a current to pixels and the scanning line for reading a current into the current source circuit in the same gate selection period, wherein the second scanning line driver circuit has a function of selecting an opposite scanning line with respect to the first scanning line driver circuit.

6. The light-emitting device according to claim 5, wherein the light-emitting device is incorporated into an electronic apparatus selected from the group consisting of a video camera, a digital camera, a goggles-type display, a navigation system, a sound reproduction device, a lap-top computer, a game machine, a portable information terminal, an image reproduction apparatus.

7. A light-emitting device comprising:

a signal line driver circuit that includes plural current source circuits connected with the same image signal current input line;

a first scanning line driver circuit;

a second scanning line driver circuit; and a pixel region, wherein the first scanning line driver circuit has a function of selecting a scanning line for inputting a current to pixels and the scanning line for reading a current into the current source circuits in the same gate selection period, wherein the second scanning line driver circuit has a function of selecting an opposite scanning line with respect to the first scanning line driver circuit.

8. The light-emitting device according to claim 7, wherein the light-emitting device is incorporated into an electronic apparatus selected from the group consisting of a video camera, a digital camera, a goggles-type display, a navigation system, a sound reproduction device, a lap-top computer, a game machine, a portable information terminal, an image reproduction apparatus.

9. A light-emitting device comprising:

plural scanning lines;

plural signal lines;

plural current source circuits being connected with the respective signal lines; and plural pixels each of which is provided with a self-light-emitting element, wherein a horizontal period is divided into plural periods, wherein one of the plural current source circuit reads an image signal in one of the divided horizontal periods, wherein the other of plural current source circuits writes an image signal current to one of the plural pixels through one of the plural signal lines in the one of the divided horizontal periods.

10. The light-emitting device according to claim 9, wherein the self-light-emitting element is an OLED.

11. The light-emitting device according to claim 9, wherein the current source circuit is formed in a signal line driver circuit.

12. The light-emitting device according to claim 9, wherein the light-emitting device is incorporated into an electronic apparatus selected from the group consisting of a video camera, a digital camera, a goggles-type display, a navigation system, a sound reproduction device, a lap-top computer, a game machine, a portable information terminal, an image reproduction apparatus.

13. A light-emitting device comprising:

plural scanning lines;

plural signal lines;

plural current source circuits being connected with the respective signal lines;

plural pixels each of which is provided with a self-light-emitting element, means for dividing a horizontal period into plural periods;

means for reading image signals by part of the plural current source circuits in one of the divided horizontal periods; and means for writing an image signal current to part of the plural pixels by the other part of the plural current source circuits through part of the plural signal lines, respectively in the one of the divided horizontal periods.

14. The light-emitting device according to claim 13, wherein the plural current source circuit is formed in a signal line driver circuit.

15. The light-emitting device according to claim 13, wherein the light-emitting device is incorporated into an electronic apparatus selected from the group consisting of a video camera, a digital camera, a goggles-type display, a navigation system, a sound reproduction device, a lap-top computer, a game machine, a portable information terminal, an image reproduction apparatus.

* * * * *